US005163895A

United States Patent [19]

Titus

[11] Patent Number: 5,163,895

[45] Date of Patent: Nov. 17, 1992

[54] CENTRIFUGE-DRIER

[76] Inventor: Hans-Joachim Titus, 8, Quai de Sanbarbani, Monaco

[21] Appl. No.: 689,961

[22] Filed: Apr. 23, 1991

[30] Foreign Application Priority Data

Apr. 26, 1990 [DE] Fed. Rep. of Germany ..... 4013388

[51] Int. Cl.[5] ..... B04B 1/20

[52] U.S. Cl. ..... 494/36; 494/29; 494/40; 494/56; 494/13

[58] Field of Search ..... 494/36, 27, 29, 37, 494/38, 43, 56, 40, 48, 13, 26, 60, 25

[56] References Cited

U.S. PATENT DOCUMENTS

| | | | |
|---|---|---|---|
| 1,312,316 | 8/1919 | Ger | 494/36 |
| 1,355,559 | 10/1920 | Mauss | 494/40 |
| 3,301,708 | 1/1967 | Rotel | 494/36 |
| 3,437,209 | 4/1969 | Evans | 494/27 |
| 3,674,206 | 7/1972 | Wendt, Jr. | 494/43 |
| 3,824,701 | 7/1974 | Norquist | 494/60 |
| 4,000,074 | 12/1976 | Evans | 494/36 |
| 4,245,777 | 1/1981 | Lavanchy | 494/53 |
| 4,339,072 | 7/1982 | Hiller | 494/56 |

*Primary Examiner*—Philip R. Coe
*Assistant Examiner*—Reginald L. Alexander
*Attorney, Agent, or Firm*—Shlesinger, Arkwright & Garvey

[57] ABSTRACT

A centrifugal drier for a product, comprises a horizontally supported rotating drive shaft including an axial passageway adapted to be a filling pipe for the product; a drum having a closed end secured to one end of the drive shaft and an open end; a conical filter mounted inside the drum, tapering from narrow to wide toward the drum open end; a rotatably mounted baffle disk being displaceable between a closed position sealing the drum open end and an open position for adjustable discharge of the dried product, the filter and the baffle disk defining a work area, the axial passageway communicating with the work area; an annular duct operably associated with the drum open end and cooperating with the baffle disk for receiving the dried product when the baffle disk is in the open position; and a backflusher disposed outside the filter for backflushing the filter with fluid.

22 Claims, 5 Drawing Sheets

CENTRIFUGE-DRIER

Figure 1:
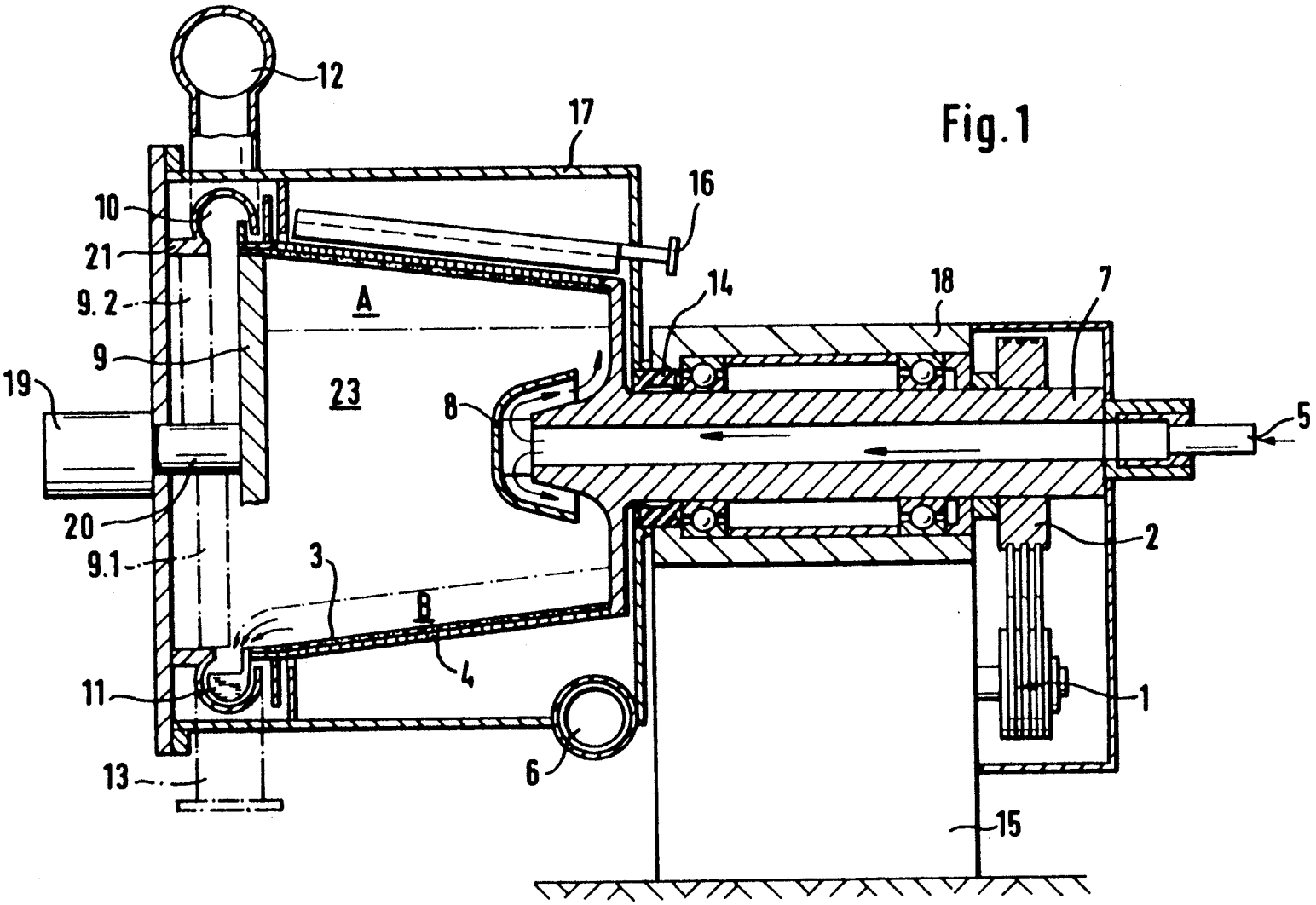

The invention concerns a centrifuge-drier, i.e. centrifugal desiccating equipment, with a horizontally supported drive shaft and a closed, co-rotating drum, a filter mounted inside the drum and enclosing a work space conically flaring from the connection side of the drive shaft, further an axially displaceable baffle disk forming one end face of the work space, and a centrifuge housing encapsulating the drum and the baffle disk.

Filter centrifuges are used when mechanically separating solids from suspensions following the termination of chemical, biological or fermentation procedures. All centrifuges require draining accessories. Known draining peelers cause contaminations on account of their motions, for instance seal abrasions, which are inadmissible in highgrade pharmaceuticals. Peelers contain deposition surfaces wetted by the suspension and which following dripping may give rise to scaling of unwashed product. The scale is reinforced by the fine dust created in peeling that arrives at the still moist deposition surfaces. Upon reaching a given thickness, the scale pops off during the dry-centrifuging phase, wherein vibrations are strongest, and contaminates the end product.

Other drawbacks attach to peelers because a residual layer always stays in the drum and increasingly is compacted so that the filtration takes longer for the ensuing work-batches. The centrifuge must be stopped and opened to remove the residual layer, and solvent vapors must be evacuated while scraping and shoveling the residual layer. Moreover foreign particles enter products with high purity requirements and both the work force and the environment are stressed. Peeling centrifuges incur not only contamination, but also losses on account of the product moving into the mother-liquor chamber during peeling. Where substances containing solvents are concerned, new inertness must be assured after the centrifuge has been opened, which entails expenditure of $N_2$ and time.

While high purity is achieved with vertical centrifuges drained at the top, on the other hand the pipe-system connecting to the peeler is unsuited for frequent product changes and raises the risk of contamination. Known push-type centrifuges can be used only for products with grain sizes $>40\ \mu$. The flow-control on the intake-side to move the filtered product by means of a pivoting push base into the conical region is disadvantageous, as it passes from there in uncontrolled manner to the discharge chute. The dwell-time of the product along the conical wall being uncontrollable, this kind of centrifuge is suitable only for rapidly filtered, coarsely crystalline mass products of low quality. Because the product moves uncontrollably through the conical region on account of its inhomogeneous density, washing to free the mother liquor is impossible.

The object of the invention is to create industrial separation equipment eliminating the above drawbacks and capable of mechanical and/or thermal separation in continuous or discontinuous operation. It shall be possible to discharge the product in its moist or also in its dry state entirely without resort to peeler and without leaving a residual layer.

The proposed invention comprises a pressure chamber centrifuge drum with a solid wall and an exchangeable multi-layer, sintered wire-cloth filter cone of low surface friction. The annular space between the solid-wall and the filter inset is divided into several chambers each containing a diffuser aperture through which compressed air is injected by means of stationary nozzles to detach the product from the filter and to simultaneously pass through and dry the product. The open drum end comprises a flange acting as a rest for an axially displaceable baffle disk acting as a hermetic seal and making it possible to fill or wash by means of the drive shaft the work space in the filter cone as a closed container.

The process steps filling/washing/drying/centrifuging are carried out in the work space which is devoid of fittings exposed to being wetted by the mother liquor and which assures maximum product purity. After centrifuging to dryness, the work space may be subjected to excess pressure to reduce the capillary rise of the residual moisture in the product layer adhering to the filter cone and to achieve the least final moisture because the gas cannot escape through the sealed baffle disk.

Upon termination of filtration, the product layer is pried off the filter cone by the ultrasonic flow impulses injected into the pressure chambers and by the pressure rise so induced. Illustratively the product forms a bulk filling about 50% of the work space and conveyed at reduced angular speed as in a rotary drier. Hot gas is injected into the low pressure chambers during this stage and passes through the rolled-over product from below and on account of the high gas speed flows with turbulence through the product with high heat exchange and efficient drying. The product being present only on part of the filter cone, the inflowing gas passes through the cone cleaned of dust and escapes through the diffusers into the centrifuge housing where it is moved through connection stubs.

The drying stage can be carried out at reduced, normal or excess pressure and while it takes place the baffle disk rests hermetically against the drum flange, as a result of which no flow losses are suffered. To empty the work space following drying, the baffle disk is adjusted by means of an axial drive unit and by means of a switch is made either to be co-rotating with the drum or to be uncoupled.

The flared end of the drum is surrounded by an inwardly open annular duct from which issue one or more product conveyance conduits. The baffle disk is displaceable between a position sealing the intake to the annular duct and a position releasing the discharge of the work space. By means of impulses of compressed gas fed into the particular lower pressure chamber, and while the drum is rotating slowly, the product passes from the filter cone into the annular duct where it may be made to circulate mechanically and/or by using injected compressed gas, and from which it leaves through a tangential discharge.

At least one bucket may be mounted to the drum flange to feed the product from one or more conveyance conduits to the annular duct. When there is product change-over, the centrifuge housing together with the drum and the annular duct may be flushed and be washed while rotating the drum, the washing liquid following the same path as otherwise does the product.

Another embodiment of the invention provides a conical perforated drum with a metal-filter inset. At least one manifold conduit along the outer drum surface and with radially inward-pointing nozzles is present inside the centrifuge housing and serves to supply washing liquid to back-flush the filter surface and/or to supply compressed air or hot gas. Impulses of compressed hot gas may be applied to detach the dehydrated product from the filter and to remove it. By supplying the hot gas from the outside, the product flowability along the conical drum wall can be increased.

A washing pipe passing through the drive shaft into the drum may comprise nozzles loaded from the inside surface of the drum wall in order to allow washing the product between the initial filtration and the terminal reduction of the final moisture. In this implementation mode as well the product is discharged completely in that the entire filter cake is continuously displaced along the drum wall to the annular duct.

The conical drum outside surface may comprise several longitudinal zones with different aperture angles, illustratively 15° at a first third of the length for initial filtration, a smaller angle at the second third of the length ensuring slower longitudinal advance, where in addition to the discharge-slot fine-controlled by the baffle disk, also the product dwell-time in the work space is affected by further parameters such as drum speed, friction, viscosity or thixotropy of the product mixture, amplitudes of the externally applied impulses of compressed gas etc. Moreover the baffle disk and its adjustability allow choosing between batch and continuous operation.

Further features and advantages of the invention are shown by the description of illustrative embodiments of the centrifuge-drier of the invention in relation to the drawings displaying details of the invention, and further in the claims. The particular features of the claims may be embodied individually per se or as several in arbitrary combinations as further embodiments of the invention. The drawings all are schematic.

Figure 2:
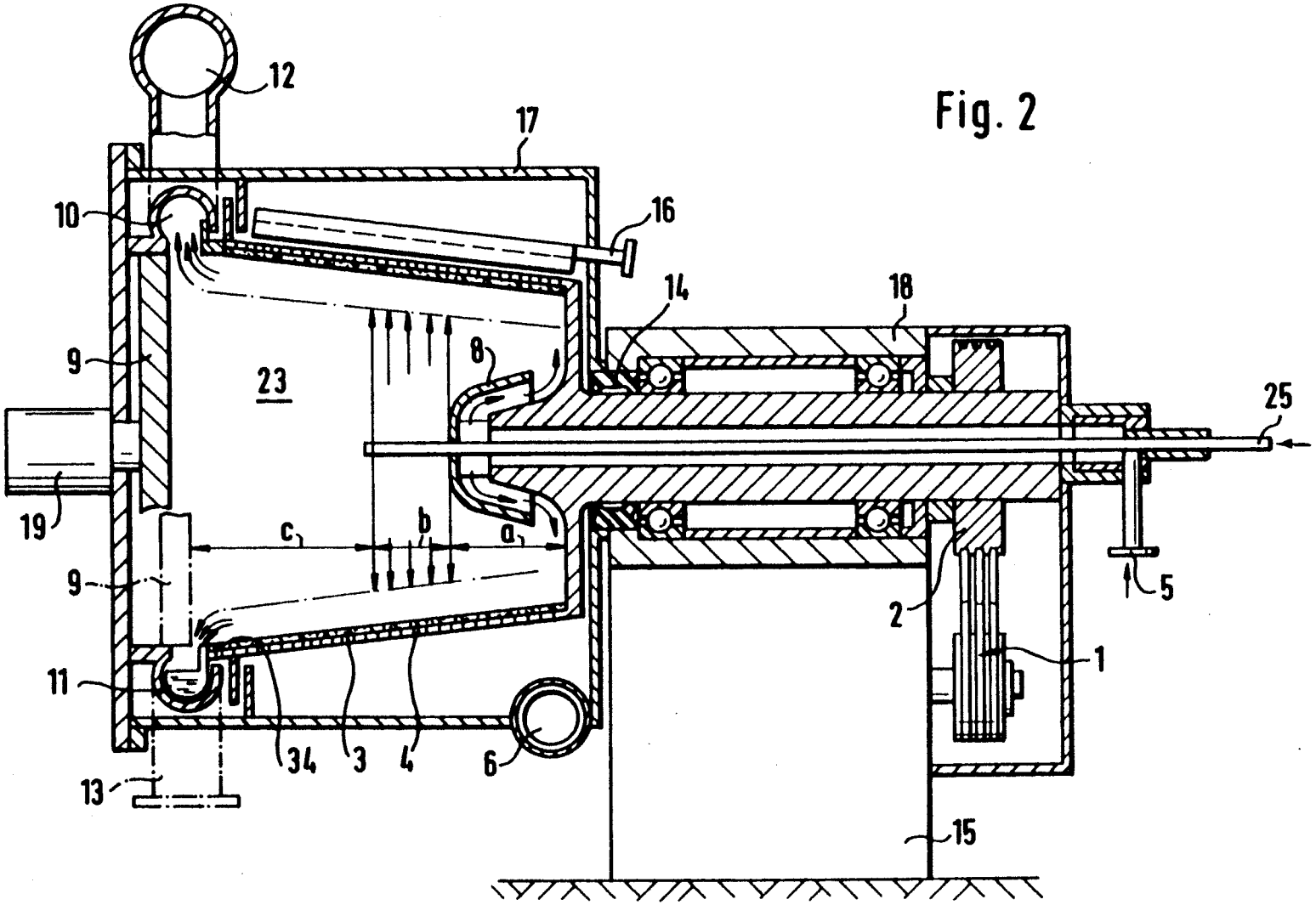
Figure 3:
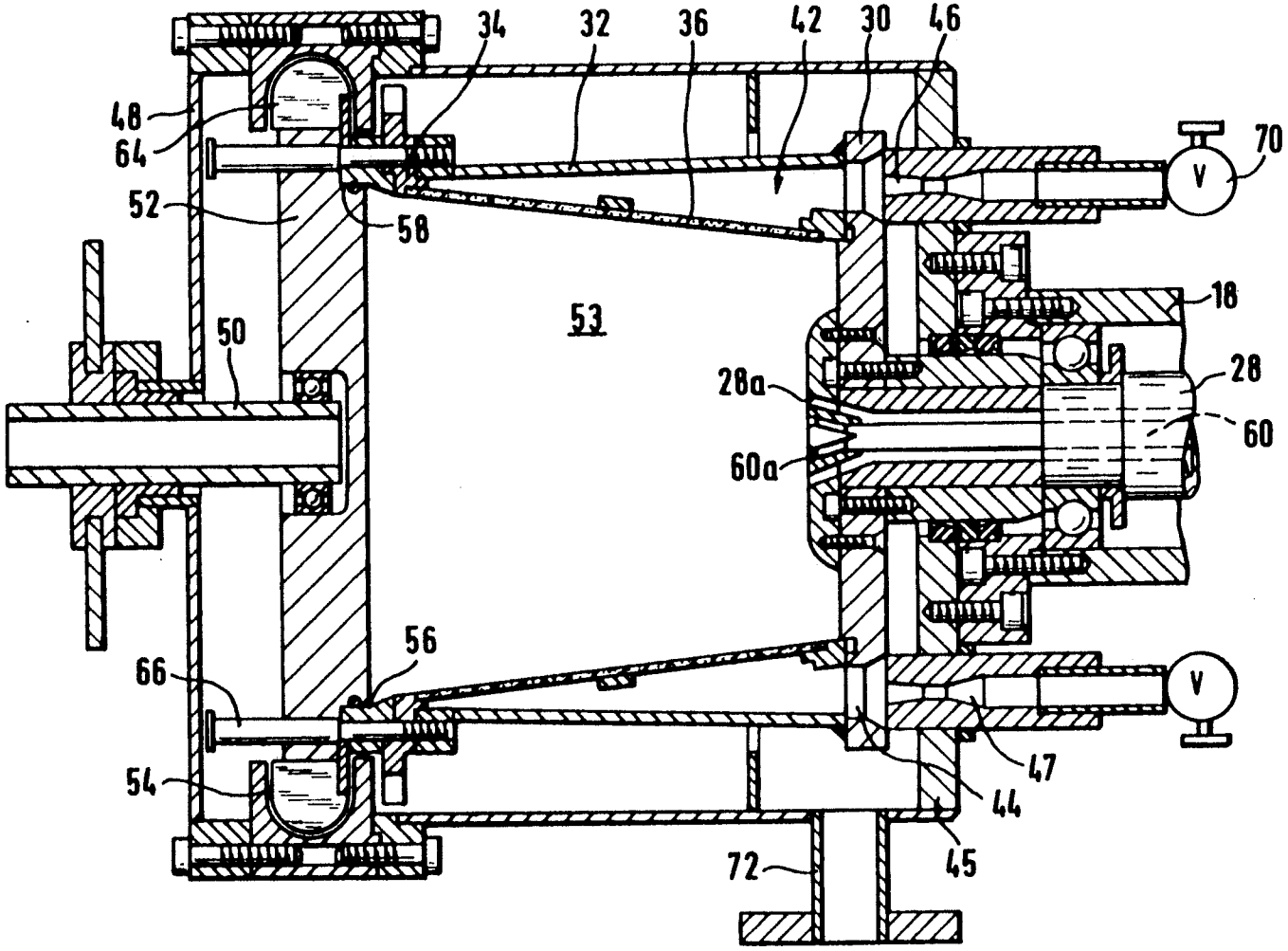
Figure 4:
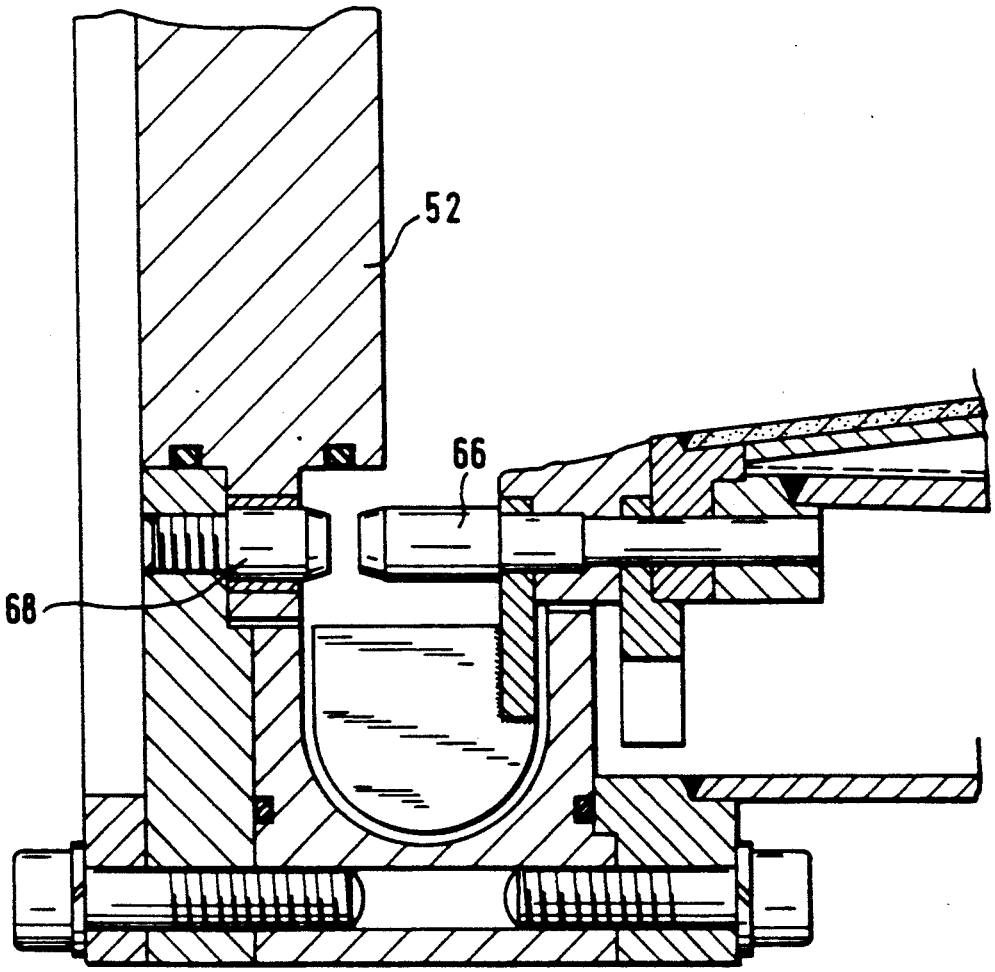
Figure 5:
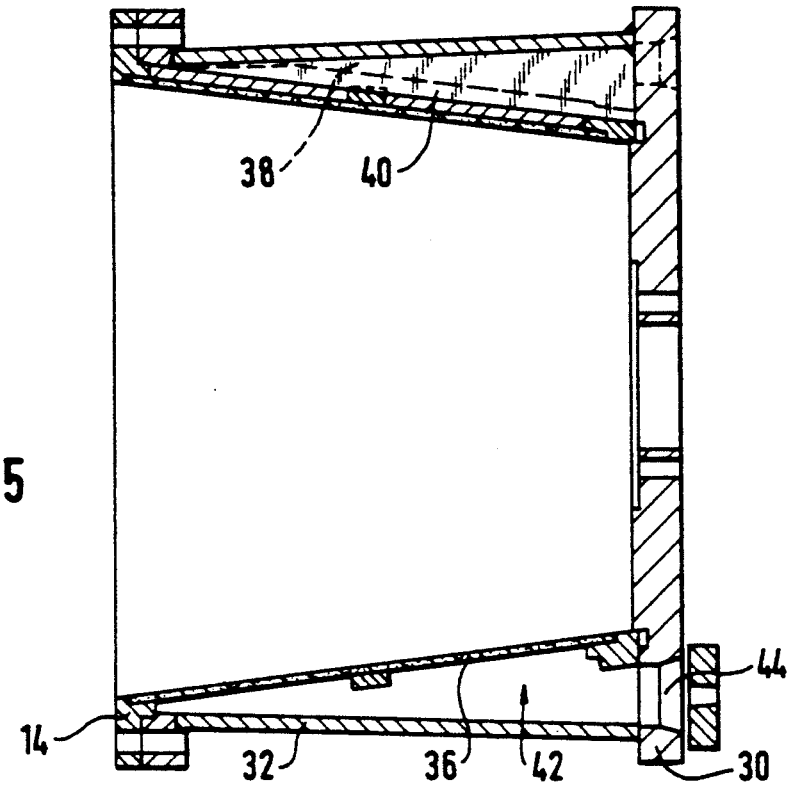
Figure 6:
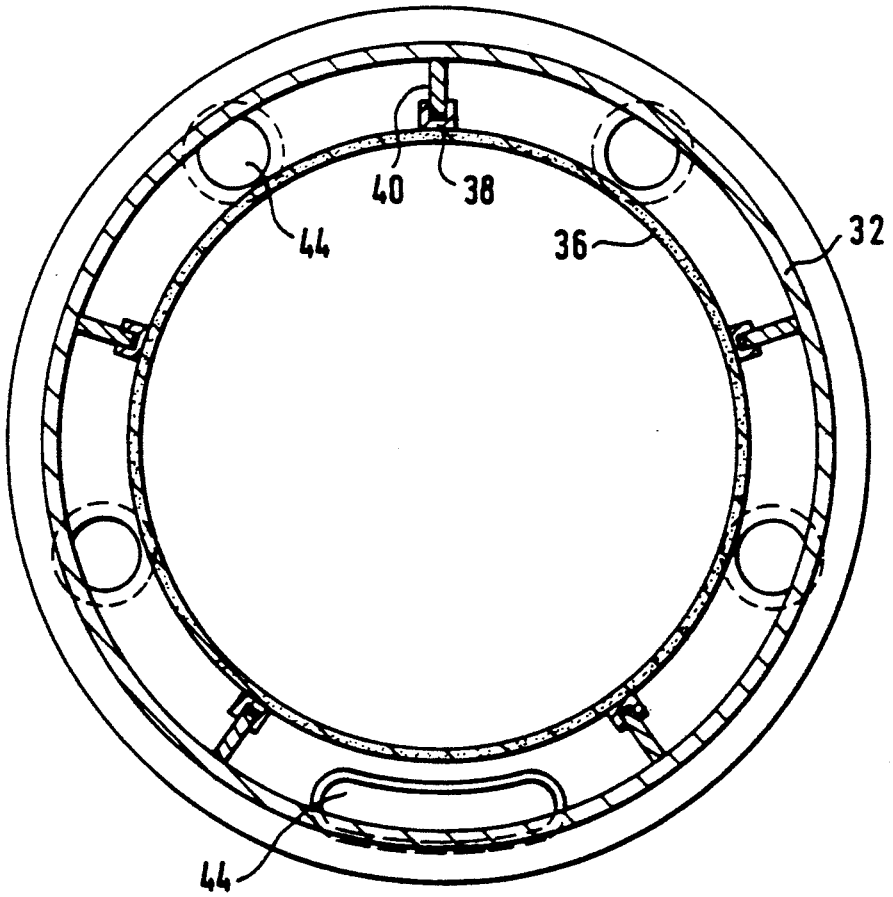

FIG. 1 is a single-stage centrifuge-drier, i.e. centrifugal desiccating equipment of the invention in longitudinal section, designed for batch operation, FIG. 2 is a centrifuge-drier similar design to that of FIG. 1 with an inner wash pipe for continuous operation, FIG. 3 is a variation of the centrifuge-drier of FIG. 1 with a pressure-chamber centrifuge-drum, FIG. 4 is a partial view from FIG. 3 with modified drive bolts, FIG. 5 is an enlarged longitudinal section of the centrifuge drum and FIG. 6 is an enlarged cross-section of the centrifuge drum of FIG. 3.

As shown in FIG. 1, a horizontally supported hollow shaft 7 is linked by a V-belt drive 2 to a frequency-controlled drive motor 1. The shaft 7 bears a conical, perforated centrifuge drum 4 containing a filter cone 3 closed on its surface and preferably consisting of woven, sintered metal screens. The hollow shaft 7 supports a reversing hood 8 in front of its mouth in order to guide the fed-in suspension in the direction of the arrows to the least drum circumference. The hollow shaft 7 rests in a bearing housing 18 on a machine post 15 and holds by means of an axial face seal a connector 5 to supply suspension or washing liquid.

A centrifuge housing 17 is rigidly joined to the bearing housing 18 and is sealed by means of a shaft seal 14 with respect to the shaft 7 and is closed by a lid through which a baffle disk 9 can be axially displaced. The baffle disk 9 rests on a central shaft 20 actuated by a drive unit 19 mounted externally on the lid.

The baffle disk 9 is displaceable along a stationary guide 21 as far as into an inside guide surface at the flaring end of the drum 4 in order to seal the work space 23 in discontinuous operation and in co-rotating manner. A product cake A is produced from the filtered suspension above the center axis. The product rid of mother liquor is washed and centrifuged till dry. Thereupon, at reduced speed and with opened baffle disk 9.1 the product is emptied solely by means of centrifugal force into an annular duct 10 adjoining in sealed manner the circumference of the flared drum end, said duct 10 being inwardly open and being of any suitable cross-section, resting on the centrifuge housing 17 or its lid and comprising a guide 21 supporting the baffle disk in its open position 9.2. When centrifuging till dry, the drum 4 may be subjected, through the hollow shaft, to excess pressure. Thereafter, while the drum is slowly rotating, compressed hot-gas impulses may be introduced through one or more manifold conduits 16 which shall totally detach the product cake A from the heated filter surface 3. The hot gas arriving in the drum 4 escapes through a co-rotating filter, affixed to the baffle disk 9, and through the shaft 20 into a vacuum line.

As shown by FIG. 2 for continuous operation, a defined discharge slot is adjusted by the baffle disk 9 and the drum 4 is constantly loaded with suspension. The mother liquid is centrifuged onto a first cone length "a" and collected in a drain pipe 6. The product is washed along a second cone length "b" washing liquid injected through the conduit 25 and thereafter it is centrifuged dry at a cone length "c". The centrifuged moist product flows without leaving a residue into the annular duct 10 inside which buckets 11 affixed to the drum circumference move the product to a pneumatic drier 12 or, through the indicated drop conduit 13, to a vacuum drier or container.

Radially inward nozzles start from the manifold conduit 16 and in special cases may consist of a single slot, selectively serving to supply washing liquid, to backflush the filter surface and/or to supply compressed air or hot gas.

As regards the centrifuge-drier shown in FIGS. 3 through 6, a drum bottom 30 is affixed to the end of the hollow shaft 28 inserted in sealed manner into the centrifuge housing 17, with a closed drum casing 32 which is cylindrical or conically slightly tapering at its free end starting at said bottom. A reinforced metal filter cone 36 consisting of a sintered filter cloth extends between the inside end of a drum flange 34 and the drum bottom , and U channels 38 are welded to the outside of said cone 36 at circumferential spacings to receive webs 40 stretching radially inward from the drum casing 32 and dividing the conical annular space into mutually hermetic pressure chambers 42. Each pressure chamber contains a circular or elongated diffuser aperture 44 in the drum bottom 30, with one or more nozzles 46 with valve control 70 mounted in the stationary housing back wall 45 forcing pressure impulses through said apertures in their upper positions at time-selected intervals. The pressure rise generated by the ultrasonic flow in the pressure chamber 42 causes detachment and dropping-off of the product layer adhering to the inside filter cone 36 from the entire segment surface.

A baffle disk 52 is rotatably supported on a sealed shaft 50 displaceable in the housing lid 48 and similarly to the embodiment of FIGS. 1 and 2 is displaceable between an end position sealing the work space 53 and an intermediate position more or less opening the discharge to the annular duct 54. The drum flange 34 bears a frame with an annular surface 56 for the stop-disk circumference 58. Suspension or washing liquid are fed through the hollow shaft 28 and through an inside conduit 60 to the conical annular nozzles 28*a* and 60*a* respectively. As a result fully automatic loading is feasible because the co-rotating liquid issuing in flaring manner from the annular nozzles can be guided on account of their variable intake pressure—especially as regards full washing of the work space—onto any desired zone of the inside wall of the filter cone and of the baffle disk. Buckets 64 entering the annular duct 54 and also drive bolts 66 are affixed to the drum flange 34, said bolts passing in sealed manner through apertures into the stop disk 52 and transmitting the drum rotation. As shown by FIG. 4, the drive bolts 66 are shortened so that the baffle disk will be uncoupled beyond a given aperture-size of the annular duct from the drive system and shall be held in place by stop bolts 68.

When centrifuging, the filtered-off mother liquor or the washing liquid passes through the filter cone 36 into the pressure chambers 42 and from there drains along the drum surface through the diffuser apertures 44 into the housing or through its collecting stub 72. In order to assure liquid drainage for a cylindrical drum case 32, the entire equipment is slightly slanted during centrifuging, namely it is raised at the left end in FIG. 2. After the dessication, the drum space is loaded through the hollow shaft 28 with excess gas pressure in order to reduce the capillary rise of the product's residual moisture.

To detach the product layer adhering to the filter cone 36, first one may blow hot gas in low-pressure impulses into the pressure chambers 42 to heat the filter cone and start drying the sticky base layer of the product. Following this pre-drying, high-pressure impulses are applied, whereby the product layer crumbles and drops off. At the same time the filter cone is cleaned from the outside to the inside.

Following cleaning of the filter cone in the illustratively five pressure chambers shown in FIG. 6, hot gas is admitted through the lower nozzle 47 in pressure impulses in order to dry the product convectively by turbulence. The product collected in the lower half of the work space is constantly rearranged at low angular speed and thereby drying is accelerated. The gas introduced through the nozzle is exhausted through the upper cone half.

Because the gas enriched in the work space with solvent and other liquid vapors and rid from the product in the filter and flowing out of the pressure chambers 42 already may condense in the centrifuge housing 42 where it moves over a short path to a condenser, a high and available temperature difference is available for drying in contrast with the case in which the product is detached from the filter drum by a peeling head and is accompanied in the same direction by a convective drying gas as far as a product separation filter and therefore must have an exhaust gas temperature at least 30° C. higher than the dew point.

By the convective flow of hot gas being separated from the product transport, only about half the heat demanded by the known peeling method to heat the drying gas is required at constant drying time. The product prepared by employing the novel gas guidance presents substantially lower final moisture compared with flow drying or vacuum contact drying, said final moisture of the invention being in ppm range.

Upon termination of the drying carried out in the work space 53 at excess or reduced pressure and with opened discharge to the annular duct, the impulses of gas pressure further applied to the product cause pulsed advance wherein the conveying gas drives the product through the annular duct into a dust separator or to another destination.

The desired complete product discharge from the accessory-free work space and in the absence of any residual layer and without peeling means is achieved by the combination of the following parameters:

low surface friction of the metal filter cone,
cone-angle of the exchangeable filter cone,
drum rpm
compressed-gas impulse flow jointly with adjustable baffle disk.

I claim:

1. A centrifugal dryer for a product, comprising:

a) a horizontally supported rotating drive shaft including an axial passageway adapted to be a filling pipe for the product;

b) a drum having a closed end secured to one end of said drive shaft and an open end;

c) a conical filter mounted inside said drum, tapering from narrow to wide toward said drum open end;

d) a rotatably mounted baffle disk being displaceable between a closed position sealing said drum open end and an open position for adjustable discharge of the dried product, said filter and said baffle disk defining a work area, said axial passageway communicating with said work area;

e) a duct operably associated with said drum open end and cooperating with said baffle disk for receiving the dried product when said baffle disk is in said open position; and f) means disposed outside said filter for providing fluid flow through said filter.

2. A centrifugal dryer as in claim 1, wherein:

a) said filter comprises wire cloth.

3. A centrifugal dryer as in claim 1, wherein:

a) said passageway includes a discharge end within said work area; and b) a baffle disk operably associated with said passageway discharge end.

4. A centrifugal dryer as in claim 1, wherein:

a) said baffle disk includes a shaft rotatably secured thereto; and b) said baffle disk shaft is axially movable, thereby permitting said baffle disk to be in said open and closed positions.

5. A centrifugal dryer as in claim 4, and further comprising:

a) a stationary centrifuge housing enclosing said drum and said baffle disk;

b) an end wall of said housing being disposed adjacent said drum open end; and c) said baffle disk shaft is slidably carried by said end wall.

6. A centrifugal dryer as in claim 1, and further comprising:

a) a washpipe disposed through said passageway, said washpipe communicating with said work area.

7. A centrifugal dryer as in claim 6, wherein:

a) said washpipe includes a nozzle communicating with said work area.

8. Centrifugal dryer as in claim 1, wherein:

a) said passageway includes a discharge end within said work area;

b) said axial passageway includes conical annular nozzles operably disposed at said discharge end, thereby to direct suspension or washing liquid to impinge on any desired longitudinal portion of said filter cone by varying intake pressure.

9. A centrifugal dryer as in claim 1, wherein:
a) said drum open end includes a flange; and
b) said baffle disk includes a sealing surface cooperating with said flange when said baffle disk is in said closed position.

10. A centrifugal dryer as in claim 1, wherein:
a) said drum is conical and perforated.

11. A centrifugal dryer as in claim 1, wherein:
a) said providing means includes at least one manifold conduit having discharge nozzles disposed radially inwardly toward said work area.

12. A centrifugal dryer as in claim 1, wherein:
a) said providing means includes pressure chambers defined by said drum and said filter; and
b) at least one nozzle adapted for intermittent impulses of fluid into said pressure chambers.

13. A centrifugal dryer as in claim 12, wherein:
a) said drum includes a drum shell and a drum bottom;
b) said pressure chambers are disposed between said drum shell and said filter cone;
c) said drum bottom includes diffuser apertures communicating with respective pressure chambers; and
d) said apertures are associated with upper and lower nozzles stationarily disposed on the same distance away from said shaft as said apertures.

14. A centrifugal dryer as in claim 12, wherein:
a) said drum includes a drum bottom;
b) a stationary centrifuge housing enclosing said drum and said baffle disk;
c) said housing includes an end wall disposed adjacent said drum bottom; and
d) said at least one nozzle is disposed in said end wall.

15. Centrifugal dryer as in claim 14, wherein:
a) said drum bottom includes diffuser apertures comprising curved elongated slots communicating with respective pressure chambers.

16. Centrifugal dryer as in claim 15, wherein:
a) said drum includes a drum shell having an inside periphery; and
b) each of said diffuser apertures includes an edge that projects beyond said inside periphery of said drum shell.

17. Centrifugal dryer as in claim 15, wherein:
a) said at least one nozzle includes an end face that periodically lines up with each of said diffuser apertures as said drum rotates with said shaft.

18. Centrifugal dryer as in claim 1, wherein:
a) said duct is annular; and,
b) at least one bucket secured to said drum open end and operably associated with said duct.

19. Centrifugal dryer as in claim 1, wherein:
a) said filter cone includes a flaring end adjacent said drum open end;
b) said drum open end and said filter cone flaring end are connected to each other in sealing manner;
c) a circumferential flange operably associated with said drum open end and said filter cone flaring end; and
d) axial bolts carried by said flange and extending through associated apertures in said baffle disk thereby to permit said baffle disk to be engaged with said drum and be rotated therewith when said baffle disk in said closed position.

20. Centrifugal dryer as in claim 19, wherein:
a) said bolts extend partway across said duct such that said baffle disk is disengaged from said drum after traversing partway across said duct.

21. A centrifugal dryer for a product, comprising:
a) a horizontally supported drive shaft including an axial passageway adapted as a filling pipe;
b) a drum bottom secured in co-rotating manner to one end of said shaft and including a free end;
c) a perforated conical drum shell secured to said drum bottom, tapering from narrow to wide from said drum bottom;
d) a conical filter insert covering the inside surface of said drum shell;
e) a rotatably mounted baffle disk being axially displaceable between a closed position for sealing said free end of said drum shell and an open position for adjustable discharge of the dried product;
f) a stationary annular duct operably associated with said free end of said drum shell, said annular duct inwardly opening into said drum shell, said annular duct being selectively closed by said baffle disk;
g) at least one product conveyance conduit connected to said annular duct;
h) a stationary centrifuge housing enclosing said drum shell and said baffle disk, said housing including an end wall;
i) a shaft secured to said baffle disk and slidably secured to said end wall; and
j) at least one manifold conduit extending axially and parallel to said drum shell, said manifold conduit including nozzles disposed radially and inwardly toward said drum shell for fluids.

22. A centrifugal dryer for a product, comprising:
a) a horizontally supported drive shaft having an axial passageway adapted as a filling pipe;
b) a drum bottom secured in co-rotating manner to one end of said drive shaft;
c) a drum shell secured to said drum bottom and including a free end;
d) a filter cone secured inside said drum, said filter cone having a tapered end secured at said drum bottom and a flaring end secured at said drum shell;
e) a rotatably mounted baffle disk displaceable between a closed position sealing said free end of said drum shell and an open position for adjustable discharge of the dried product;
f) said drum shell and said filter cone forming an annular space therebetween, said annular space being divided into pressure chambers each having a diffuser aperture in said drum bottom;
g) upper and lower nozzles stationarily disposed to a frame of said centrifugal dryer, said nozzles being disposed substantially at the same radial distance from said shaft as said diffuser aperture; and
h) valve control operably associated with said nozzles for intermittent impulses of fluid when said aperture lines up with said nozzles.

* * * * *